US009972428B2

(12) United States Patent
Shindo

(10) Patent No.: US 9,972,428 B2
(45) Date of Patent: May 15, 2018

(54) NEODYMIUM-BASED RARE EARTH PERMANENT MAGNET AND PROCESS FOR PRODUCING SAME

(75) Inventor: Yuichiro Shindo, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 794 days.

(21) Appl. No.: 14/380,416

(22) PCT Filed: Aug. 31, 2012

(86) PCT No.: PCT/JP2012/072102

§ 371 (c)(1),
(2), (4) Date: Sep. 16, 2014

(87) PCT Pub. No.: WO2013/125075

PCT Pub. Date: Aug. 29, 2013

(65) Prior Publication Data

US 2015/0017053 A1 Jan. 15, 2015

(30) Foreign Application Priority Data

Feb. 23, 2012 (JP) ..... 2012-037546

(51) Int. Cl.
*H01F 1/053* (2006.01)
*H01F 41/02* (2006.01)
*H01F 1/057* (2006.01)

(52) U.S. Cl.
CPC ..... *H01F 1/0536* (2013.01); *H01F 1/0577* (2013.01); *H01F 41/0266* (2013.01)

(58) Field of Classification Search
CPC ..... H01F 1/0577; H01F 1/0536
USPC ..... 205/363, 368
See application file for complete search history.

(56) References Cited

U.S. PATENT DOCUMENTS 4,826,546 A * 5/1989 Yamamoto ..... B22F 3/24 148/102
4,898,613 A * 2/1990 Ishigaki ..... B22F 9/20 148/302
4,983,232 A 1/1991 Endoh et al.
5,118,396 A 6/1992 Claus et al.
5,472,525 A 12/1995 Tokunaga et al.
5,942,053 A 8/1999 Sekine et al.
7,485,193 B2 2/2009 Hirota et al.
7,824,506 B2 11/2010 Machida et al.
7,898,137 B2 3/2011 Miyata
2003/0019759 A1* 1/2003 Shindo ..... C25C 1/00 205/560

FOREIGN PATENT DOCUMENTS

| | | | |
|---|---|---|---|
| CN | 1232275 A | | 10/1999 |
| CN | 1383159 A | | 12/2002 |
| CN | 1395264 A | | 2/2003 |
| CN | 1403618 A | | 3/2003 |
| CN | 1492069 A | | 4/2004 |
| CN | 1492069 A | * | 4/2004 |
| CN | 101195745 A | | 6/2008 |
| JP | S61-079747 A | | 4/1986 |
| JP | S62-243731 A | | 10/1987 |
| JP | H05-047530 A | | 2/1993 |
| JP | H06-096928 A | | 4/1994 |
| JP | H06-231921 A | | 8/1994 |
| JP | H07-045413 A | | 2/1995 |
| JP | H07-090411 A | | 4/1995 |
| JP | H08-085833 A | | 4/1996 |
| JP | H09-007810 A | | 10/1997 |
| JP | H10-017908 A | | 1/1998 |
| JP | 2000-331810 A | | 11/2000 |
| JP | 2005-051002 A | | 2/2005 |
| JP | 2006-041507 A | | 2/2006 |
| JP | 2006-183096 A | | 7/2006 |
| JP | 2008-248369 A | | 10/2008 |
| JP | 2009-084627 A | | 4/2009 |
| TW | 189856 B | | 9/1990 |

OTHER PUBLICATIONS

Oberg, Erik Jones, Franklin D. Horton, Holbrook L. Ryffel, Henry H.. (2012). Machinery's Handbook (29th Edition) & Guide to Machinery's Handbook—Nickel-Chromium Cast Iron. Industrial Press.*

Tucker Jr., Robert C.. (2013). ASM Handbook, vol. 05A—Thermal Spray Technology—9.2.5 Electrolysis Process. ASM International.*

* cited by examiner

*Primary Examiner* — Colleen P Dunn
*Assistant Examiner* — Jeremy C Jones
(74) *Attorney, Agent, or Firm* — Howson & Howson LLP

(57) ABSTRACT

Provided is a neodymium-based rare earth permanent magnet having a purity of 99.9 wt % or higher excluding gas components and component elements. The present invention can remarkably improve the magnetic properties in a neodymium-based rare earth permanent magnet by highly purifying the magnetic materials. Furthermore, the present invention aims to provide a high-performance neodymium-based rare earth permanent magnet with improved heat resistance and corrosion resistance, which are inherent drawbacks of magnetic materials.

16 Claims, No Drawings

NEODYMIUM-BASED RARE EARTH PERMANENT MAGNET AND PROCESS FOR PRODUCING SAME

BACKGROUND

The present invention relates to a high purity neodymium-based rare earth permanent magnet of which magnetic properties are remarkably improved in comparison to conventional neodymium-based rare earth permanent magnets by highly purifying the magnet materials, and to a method for producing such a neodymium-based rare earth permanent magnet.

In recent years, permanent magnets are being applied to various fields pursuant to significant advances, and improvement of their performance and development of new devices are being conducted day by day. In particular, the widespread use of permanent magnets in the fields of IT, automobiles, household appliances and FA is remarkably increasing from the perspective of energy conservation and environmental countermeasures.

Permanent magnets are used, for example, in voice coil motors of hard disk drives and optical pickups of DVD/CD drives in relation to personal computers, in micro speakers and vibration motors in relation to portable phones, and in various motors such as servo motors and linear motors in relation to household appliances and industrial devices. Moreover, over 100 permanent magnets are used in a single electric vehicle such as an HEV.

As permanent magnets, known are Alnico magnets, Ferrite magnets, samarium-cobalt (SmCo) magnets, neodymium (NdFeB) magnets and the like. In recent years, the R&D of neodymium magnets is particularly active, and various efforts are being exerted for achieving higher performance of such neodymium magnets. A neodymium magnet is normally configured from a ferromagnetic $Nd_2Fe_{14}B_4$ intermetallic compound (main phase), a paramagnetic B-rich phase, a nonmagnetic Nd-rich phase, and oxides and the like as impurities. In addition, efforts for improving the magnetic properties are being exerted by adding various types of elements thereto.

For example, Patent Document 1 discloses that the magnetic properties are significantly improved by simultaneously adding Co, Al, Cu and Ti to an R—Fe—B-based rare earth permanent magnet (wherein R is one or more types among Nd, Pr, Dy, Tb, and Ho), and Patent Document 2 discloses that the maximum energy product (BH)max can become 42 MGOe or more by adding Ga while adjusting the composition.

Other methods are also known for improving the magnetic properties; namely, the method of introducing a moderate amount of oxygen, which is an impurity that causes the magnetic properties to deteriorate (Patent Document 3), the method of increasing the coercive force by suppressing the growth of the main phase crystal grains as a result of the fluorine, which was added in a moderate amount, being unevenly distributed at the grain boundary of the magnet (Patent Document 4), and the method of improving the performance of the magnet by reducing the B-rich phase and the R-rich phase that cause the magnetic properties to deteriorate, and increasing the $R_2Fe_{14}B$ phase as a main phase (Patent Document 5).

As described above, various attempts are being made in order to improve the magnetic properties such as by adding new types of component elements (rare earth elements, transition metal elements, impurity elements and the like), by adjusting the composition of the R—Fe—B-based rare earth permanent magnet, and otherwise by adjusting the crystal orientation. However, since all of these methods complicate the production process, it cannot be said that these methods are suitable for stable mass production.

Patent Document 1: JP 2000-331810 A
Patent Document 2: JP H06-231921 A
Patent Document 3: JP 2005-051002 A
Patent Document 4: International Publication No. WO2005/123974
Patent Document 5: JP H07-045413 A

SUMMARY

An object of this invention is to provide a neodymium-based rare earth permanent magnet of which magnetic properties are remarkably improved by highly purifying the magnetic materials, and heat resistance and corrosion resistance, which are inherent drawbacks of magnetic materials, are improved.

In order to achieve the foregoing object, as a result of intense study, the present inventors discovered that the use of high purity Nd, Fe, B and the like allows for remarkably-improved magnetic properties in comparison to a conventional neodymium-based rare earth permanent magnet, without complicating the production process, and further allows for improved heat resistance and corrosion resistance.

Based on the foregoing discovery, the present invention provides:

1) A neodymium-based rare earth permanent magnet, of which purity excluding gas components and component elements is 99.9 wt % or higher;

2) The neodymium-based rare earth permanent magnet according to 1) above, of which purity excluding gas components and component elements is 99.99 wt % or higher;

3) The neodymium-based rare earth permanent magnet according to 1) above, of which purity excluding gas components and component elements is 99.999 wt % or higher;

4) The Nd—Fe—B-based rare earth permanent magnet according to any one of 1) to 3) above, wherein a rate of increase of a maximum energy product (BH)max is 10% or higher in comparison to a Nd—Fe—B-based rare earth permanent magnet of a same composition; and 5) The Nd—Fe—B-based rare earth permanent magnet according to any one of 1) to 4) above, wherein a rate of increase of a heatproof temperature is 10% or higher in comparison to a Nd—Fe—B-based rare earth permanent magnet of a same composition.

The present invention further provides:

6) A method of producing a neodymium-based rare earth permanent magnet, wherein a neodymium raw material is refined by molten salt electrolysis to achieve a purity of 99.9% or higher, an iron raw material is refined by aqueous electrolysis to achieve a purity of 99.99% or higher, subsequently a compound obtained by combining the refined neodymium, the refined iron, and boron is subject to vacuum melting to obtain an ingot, the ingot is pulverized and powderized to be subject to molding by pressing, the obtained molding is subsequently sintered and subject to heat treatment, and the obtained sintered compact is thereafter subject to surface treatment;

7) The method of producing a neodymium-based rare earth permanent magnet according to 6) above, wherein the boron raw material is refined by molten salt electrolysis to achieve a purity of 99.9% or higher;

8) The method of producing a neodymium-based rare earth permanent magnet according to 6) above, wherein the neodymium raw material is refined by molten salt electrolysis to achieve a purity of 99.99% or higher, and the iron raw material is refined by aqueous electrolysis to achieve a purity of 99.99% or higher;

9) The method of producing a neodymium-based rare earth permanent magnet according to 6) above, wherein the neodymium raw material is refined by molten salt electrolysis to achieve a purity of 99.999% or higher, and the iron raw material is refined by aqueous electrolysis to achieve a purity of 99.999% or higher;

10) The method of producing a neodymium-based rare earth permanent magnet according to any one of 6) to 9) above, wherein a dysprosium raw material is refined by vacuum distillation to achieve a purity of 99.9% or higher, the refined dysprosium is added to the compound, and a resulting product is subject to vacuum melting to obtain an ingot; and 11) The method of producing a neodymium-based rare earth permanent magnet according to any one of 6) to 10) above, wherein metal plating is performed after the surface treatment.

The neodymium-based rare earth permanent magnet of the present invention has remarkably-improved magnetic properties achieved without complicating the production process, and has superior effects of being able to have improved heat resistance and corrosion resistance, which are inherent drawbacks of magnetic materials.

DETAILED DESCRIPTION

The neodymium-based rare earth permanent magnet of the present invention has a purity, excluding gas components, of 99.9 wt % or higher, preferably 99.99 wt % or higher, and more preferably 99.999 wt % or higher.

Generally speaking, the amount of gas components such as oxygen, nitrogen, hydrogen and carbon that get mixed in is greater than the amount of other impurity elements. While the inclusion of these gas components is desirably low as possible, the inclusion of these gas components on a normal level will not particularly be detrimental to achieving the object of the present invention.

The neodymium-based rare earth permanent magnet of the present invention contains Nd, Fe, and B as the typical components, but may further contain, as additive components, rare earth elements such as Dy, Pr, Tb, and Ho and transition metal elements such as Co, Ni, and Al in order to further improve the magnetic properties, corrosion resistance and/or other properties. However, these additive components are excluded from the purity of the neodymium-based rare earth permanent magnet of the present invention. In other words, it goes without saying that the foregoing additive components are not counted as impurities.

The neodymium-based rare earth permanent magnet of the present invention can remarkably improve the magnetic properties and the like, without going through any particular complicated process, by using high purity Nd, Fe, and B as the raw materials. Accordingly, since the present invention does not improve the magnetic properties by adjusting the component composition of the rare earth permanent magnet as with conventional methods, there is no particular limitation in the component composition so as long as the permanent magnet possesses standard magnetic properties.

The neodymium-based rare earth permanent magnet of the present invention possesses magnetic properties superior to the conventional rare earth permanent magnets of the same composition. As the rare earth permanent magnets, known are, for example, 31Nd-68Fe-1B (usage: MRI), 26Nd-5Dy-68Fe-1B (usage: servo motor for OA equipment), and 21Nd-10Dy-68Fe-1B (usage: motor for hybrid cars), and the magnetic properties and heat resisting properties can be improved in all of the foregoing cases by highly purifying the component elements.

With the high purity neodymium-based rare earth permanent magnet of the present invention, the rate of increase of the maximum energy product (BH)max is preferably 10% or higher, more preferably 20% or higher, and most preferably 30% or higher, in comparison to a neodymium-based rare earth permanent magnet of the same composition. Note that the maximum energy product (BH)max is the product of residual magnetic flux density (B) and coercive force (H).

Moreover, with the high purity neodymium-based rare earth permanent magnet of the present invention, the rate of increase of the heatproof temperature is preferably 10% or higher in comparison to a neodymium-based rare earth permanent magnet of the same composition. The neodymium-based rare earth permanent magnet is demanded of heat resistance in certain uses. Generally speaking, the heatproof temperature is increased by adding dysprosium or the like, but the present invention yields a superior effect of being able to improve the heat resistance without having to add this kind of element.

It is known that a neodymium-based rare earth permanent magnet is generally brittle and fragile, has inferior corrosion resistance and is apt to rust. It is also known that a neodymium-based rare earth permanent magnet has inferior heat resistance and becomes demagnetized in a high temperature range. In the present invention, it was discovered that the workability, corrosion resistance, heat resistance and other properties, which are drawbacks of general-purpose magnetic materials, can be dramatically improved at a low cost, and without having to go through a complicated process, by highly purifying the magnet materials.

Moreover, while a rare earth permanent magnet is generally plated with a metal such as nickel in order to improve corrosion resistance and reduce brittleness, the present invention can omit a process step of performing the foregoing plate processing. Meanwhile, the corrosion resistance, workability and other properties can be improved by combining the foregoing techniques.

The production method of the present invention is now explained in detail, but this production method is merely a representative and preferred example. In other words, the present invention is not limited to the following production method, and it should be easy to understand that other production methods may be arbitrarily adopted so as long as such production methods are able to achieve the object and conditions of the present invention.

Foremost, a commercially available Nd raw material (purity level of 2N), a commercially available Fe raw material (purity level of 2N to 3N), and a commercially available B raw material (purity level of 2N) are prepared. Moreover, as applicable, a commercially available Dy raw material (purity level of 2N) or the like is prepared as an additive component.

Subsequently, by subjecting the Nd raw material and the B raw material to molten salt electrolysis, it is possible to obtain Nd having a purity level of 3N to 5N and B having a purity level of 3N to 5N. Moreover, by subjecting the Fe raw material to aqueous electrolysis, it is possible to obtain Fe having a purity level of 4N to 5N.

Note that components of a low content; for instance, B, may be used as is without undergoing high purification.

These high purity raw materials are weighed to achieve the intended composition. Here, the composition may be suitably decided according to the usage. As one example, the raw materials may be combined to achieve 27 to 30 wt % of Nd, 2 to 8 wt % of Dy, 1 to 2 wt % of B, and 60 to 70 wt % of Fe.

Subsequently, these raw materials are heated and melted in a high frequency melting furnace to form an ingot. Note that the heating temperature is preferably around 1250° C. to 1500° C. Subsequently, the obtained ingot is pulverized using a well-known means such as a jet mill. Here, when giving consideration to the issue of oxidation during the mixing process, the mixing is preferably performed in an inert gas atmosphere or in a vacuum. The average grain size of the pulverized powder is preferably around 3 to 5 μm.

Subsequently, the alloyed pulverized powder is molded using a magnetic field pressing machine. Here, preferably, the magnetic field strength is set to 10 to 40 KOe, and the molding density is set to 3 to 6 g/cc. Moreover, in the case of a high-performance permanent magnet, this powder is preferably molded in a nitrogen atmosphere.

Subsequently, the obtained molding is sintered in a sintering furnace, and the sintered compact is thereafter subject to heat treatment in a heat treatment furnace. Here, preferably, the temperature of the sintering furnace is set to roughly 1000° C. to 1300° C., and the temperature of the heat treatment furnace is set to roughly 500° C. to 1000° C. The atmosphere in the respective furnaces is preferably a vacuum. Note that the sintering and heat treatment may also be performed in the same furnace.

Subsequently, the obtained sintered compact is cut using a well-known means such as a slicing machine, and the surface and peripheral portion thereof are subject to final surface treatment using a polisher or a grinder. Thereafter, as needed, the surface of the sintered compact may be subject to metal plating using nickel, copper or the like. As the plating method, a well-known method may be used. The plating thickness is preferably 10 to 20 μm.

Based on the processes described above, it is possible to obtain a neodymium-based rare earth permanent magnet having a purity of 99.9 wt % or higher excluding gas components. Note that, while the foregoing example explained a case of pulverizing an ingot and sintering the pulverized powder to prepare a rare earth permanent magnet, it is also possible to use the molded ingot as is; that is, without pulverizing the ingot, as the rare earth permanent magnet.

This kind of high purity rare earth permanent magnet can have improved magnetic properties in comparison to a conventional rare earth permanent magnet having the same composition, and additionally have improved heat resistance, corrosion resistance, and other properties. The high purity rare earth permanent magnet of the present invention can be applied to all permanent magnets containing Nd, Fe, and B as components. Accordingly, it should be easy to understand that there is no particular limitation with regard to other components and the contained amounts. In other words, the present invention is particularly useful in rare earth permanent magnets made from well-known components.

EXAMPLES

The Examples of the present invention are now explained. Note that these Examples are merely exemplifications, and the present invention is not in any way limited thereby. In other words, the present invention is limited only based on the scope of its claims, and covers various modifications other than the Examples contained herein.

Composition: 31 Nd-68Fe-1B

Example 1

A neodymium raw material having a purity level of 2N was subject to molten salt electrolysis using chloride to achieve a purity level of 3N, and 31 kg of the purified neodymium raw material was produced. Moreover, an iron raw material having a purity level of 3N was subject to hydrochloric acid-based aqueous electrolysis to achieve a purity level of 4N, and 68 kg of the purified iron raw material was produced. Moreover, 1 kg of a commercially available boron raw material having a purity level of 2N was prepared.

Subsequently, the foregoing raw materials were heated and melted in a high frequency melting furnace at a heating temperature of roughly 1250° C. to prepare an ingot. Subsequently, the prepared ingot was pulverized with a jet mill in an inert gas argon atmosphere. Here, the average grain size of the pulverized powder was roughly 4 μm.

Subsequently, the alloyed pulverized powder was molded with a magnetic field pressing machine in a nitrogen atmosphere based on the following conditions; namely, magnetic field strength of 20 KOe and molding density of 4.5 g/cc. Subsequently, the molding was sintered in a sintering furnace, and the sintered compact was thereafter subject to heat treatment in a heat treatment furnace. Here, the temperature of the sintering furnace was set to 1150° C., and the temperature of the heat treatment furnace was set to 700° C. Moreover, the atmosphere in the respective furnaces was set to be a vacuum.

The thus produced sintered compact was cut using a slicing machine, and the surface and peripheral portion thereof were subject to final surface treatment using a polisher or a grinder. Note that plate processing for oxidation prevention is often performed subsequently, but such plate processing was not performed here.

The purity and magnetic properties of the neodymium-based rare earth permanent magnet produced in Example 1 are respectively shown in Table 1. As shown in Table 1, the neodymium-based rare earth permanent magnet of Example 1 had a purity of 3N (99.9 wt %) or higher. Here, the maximum energy product (BH)max showed a favorable result at approximately 54 MGOe. Moreover, both the corrosion resistance and heat resistance showed favorable results. The corrosion resistance was evaluated by using "JIS Z2371 (salt water spray testing method)" and observing and comparing the conditions of the various samples described later (Examples and Comparative Example).

Example 2

A neodymium raw material having a purity level of 2N was subject to molten salt electrolysis using chloride to achieve a purity level of 4N, and 31 kg of the purified neodymium raw material was produced. Moreover, an iron raw material having a purity level of 3N was subject to hydrochloric acid-based aqueous electrolysis to achieve a purity level of 4N, and 68 kg of the purified iron raw material was produced. Moreover, a boron raw material having a purity level of 2N was subject to molten salt electrolysis using chloride to achieve a purity level of 4N, and 1 kg of the purified boron raw material was produced.

The subsequent processes were performed based on the same conditions as Example 1.

The purity and magnetic properties of the neodymium-based rare earth permanent magnet produced in Example 2 are respectively shown in Table 1. As shown in Table 1, the neodymium-based rare earth permanent magnet of Example 2 had a purity of 4N (99.99 wt %) or higher. Here, the maximum energy product (BH)max showed a favorable result at approximately 59 MGOe. Moreover, both the corrosion resistance and heat resistance showed favorable results.

Example 3

A neodymium raw material having a purity level of 3N was twice subject to molten salt electrolysis using chloride to achieve a purity level of 5N, and 31 kg of the purified neodymium raw material was produced. Moreover, an iron raw material having a purity level of 3N was twice subject to hydrochloric acid-based aqueous electrolysis to achieve a purity level of 5N, and 68 kg of the purified iron raw material was produced. Moreover, a boron raw material having a purity level of 2N was subject to molten salt electrolysis using chloride to achieve a purity level of 4N, and 1 kg of the purified boron raw material was produced.

The subsequent processes were performed based on the same conditions as Example 1.

The purity and magnetic properties of the neodymium-based rare earth permanent magnet produced in Example 3 are respectively shown in Table 1. As shown in Table 1, the neodymium-based rare earth permanent magnet of Example 3 had a purity of 99.999 wt % or higher. Here, the maximum energy product (BH)max showed a favorable result at approximately 62 MGOe. Moreover, both the corrosion resistance and heat resistance showed extremely favorable results.

Composition: 26Nd-5Dy-68Fe-1B

Example 4

A neodymium raw material having a purity level of 2N was subject to molten salt electrolysis using chloride to achieve a purity level of 3N, and 26 kg of the purified neodymium raw material was produced. Moreover, an iron raw material having a purity level of 3N was subject to hydrochloric acid-based aqueous electrolysis to achieve a purity level of 4N, and 68 kg of the purified iron raw material was produced. Moreover, a commercially available boron raw material having a purity level of 2N was used. In addition, a dysprosium raw material having a purity level of 2N was subject to vacuum distillation to achieve a purity level of 4N, and 5 kg of the purified dysprosium raw material was produced.

The subsequent processes were performed based on the same conditions as Example 1.

The purity and magnetic properties of the neodymium-based rare earth permanent magnet produced in Example 4 are respectively shown in Table 1. As shown in Table 1, the neodymium-based rare earth permanent magnet of Example 4 had a purity of 3N (99.9 wt %) or higher. Here, the maximum energy product (BH)max showed a favorable result at approximately 45 MGOe. Moreover, both the corrosion resistance and heat resistance showed favorable results.

Example 5

A neodymium raw material having a purity level of 2N was subject to molten salt electrolysis using chloride to achieve a purity level of 4N, and 26 kg of the purified neodymium raw material was produced. Moreover, an iron raw material having a purity level of 3N was subject to hydrochloric acid-based aqueous electrolysis to achieve a purity level of 4N, and 68 kg of the purified iron raw material was produced. Moreover, a commercially available boron raw material having a purity level of 4N was used. In addition, a dysprosium raw material having a purity level of 2N was subject to vacuum distillation to achieve a purity level of 4N, and 5 kg of the purified dysprosium raw material was produced.

The subsequent processes were performed based on the same conditions as Example 1.

The purity and magnetic properties of the neodymium-based rare earth permanent magnet produced in Example 5 are respectively shown in Table 1. As shown in Table 1, the neodymium-based rare earth permanent magnet of Example 5 had a purity of 4N (99.99 wt %) or higher. Here, the maximum energy product (BH)max showed a favorable result at approximately 54 MGOe. Moreover, both the corrosion resistance and heat resistance showed favorable results.

Example 6

A neodymium raw material having a purity level of 2N was twice subject to molten salt electrolysis using chloride to achieve a purity level of 5N, and 26 kg of the purified neodymium raw material was produced. Moreover, an iron raw material having a purity level of 3N was twice subject to hydrochloric acid-based aqueous electrolysis to achieve a purity level of 5N, and 68 kg of the purified iron raw material was produced. Moreover, a boron raw material having a purity level of 2N was subject to molten salt electrolysis to achieve a purity level of 4N, and 1 kg of the purified boron raw material was produced. In addition, a dysprosium raw material having a purity level of 2N was subject to vacuum distillation to achieve a purity level of 4N, and 5 kg of the purified dysprosium raw material was produced.

The subsequent processes were performed based on the same conditions as Example 1.

The purity and magnetic properties of the neodymium-based rare earth permanent magnet produced in Example 6 are respectively shown in Table 1. As shown in Table 1, the neodymium-based rare earth permanent magnet of Example 6 had a purity of 5N (99.999 wt %) or higher. Here, the maximum energy product (BH)max showed a favorable result at approximately 59 MGOe. Moreover, both the corrosion resistance and heat resistance showed favorable results.

Composition: 21Nd-10Dy-68Fe-1B

Example 7

A neodymium raw material having a purity level of 2N was subject to molten salt electrolysis using chloride to achieve a purity level of 3N, and 21 kg of the purified neodymium raw material was produced. Moreover, an iron raw material having a purity level of 3N was subject to hydrochloric acid-based aqueous electrolysis to achieve a purity level of 4N, and 68 kg of the purified iron raw material was produced. Moreover, a commercially available boron raw material having a purity level of 2N was used. In addition, a dysprosium raw material having a purity level of 2N was subject to vacuum distillation to achieve a purity level of 3N, and 10 kg of the purified dysprosium raw material was produced.

The subsequent processes were performed based on the same conditions as Example 1.

The purity and magnetic properties of the neodymium-based rare earth permanent magnet produced in Example 7 are respectively shown in Table 1. As shown in Table 1, the neodymium-based rare earth permanent magnet of Example 7 had a purity of 3N (99.9 wt %) or higher. Here, the maximum energy product (BH)max showed a favorable result at approximately 40 MGOe. Moreover, both the corrosion resistance and heat resistance showed favorable results.

Example 8

A neodymium raw material having a purity level of 2N was subject to molten salt electrolysis using chloride to achieve a purity level of 4N, and 21 kg of the purified neodymium raw material was produced. Moreover, an iron raw material having a purity level of 3N was subject to hydrochloric acid-based aqueous electrolysis to achieve a purity level of 4N, and 68 kg of the purified iron raw material was produced. Moreover, a commercially available boron raw material having a purity level of 2N was subject to molten salt electrolysis to achieve a purity level of 4N, and 1 kg of the purified boron raw material was produced. In addition, a dysprosium raw material having a purity level of 2N was subject to vacuum distillation to achieve a purity level of 4N, and 10 kg of the purified dysprosium raw material was produced.

The subsequent processes were performed based on the same conditions as Example 1.

The purity and magnetic properties of the neodymium-based rare earth permanent magnet produced in Example 8 are respectively shown in Table 1. As shown in Table 1, the neodymium-based rare earth permanent magnet of Example 8 had a purity of 4N (99.99 wt %) or higher. Here, the maximum energy product (BH)max showed a favorable result at approximately 47 MGOe. Moreover, both the corrosion resistance and heat resistance showed favorable results.

Example 9

A neodymium raw material having a purity level of 2N was twice subject to molten salt electrolysis using chloride to achieve a purity level of 5N, and 26 kg of the purified neodymium raw material was produced. Moreover, an iron raw material having a purity level of 3N was twice subject to hydrochloric acid-based aqueous electrolysis to achieve a purity level of 5N, and 68 kg of the purified iron raw material was produced. Moreover, a commercially available boron raw material having a purity level of 2N was subject to molten salt electrolysis to achieve a purity level of 4N, and the purified boron was used. In addition, a dysprosium raw material having a purity level of 2N was subject to vacuum distillation to achieve a purity level of 4N, and 10 kg of the purified dysprosium raw material was produced.

The subsequent processes were performed based on the same conditions as Example 1.

The purity and magnetic properties of the neodymium-based rare earth permanent magnet produced in Example 9 are respectively shown in Table 1. As shown in Table 1, the neodymium-based rare earth permanent magnet of Example 9 had a purity of 5N (99.999 wt %) or higher. Here, the maximum energy product (BH)max showed a favorable result at approximately 52 MGOe. Moreover, both the corrosion resistance and heat resistance showed favorable results.

Composition: 31 Nd-68Fe-1B

Comparative Example 1

26 kg of a commercially available neodymium raw material having a purity level of 2N were prepared. Moreover, 68 kg of commercially available iron having a purity level of 3N were prepared. Moreover, 1 kg of commercially available boron having a purity level of 2N was prepared.

The subsequent processes were performed based on the same conditions as Example 1.

The purity and magnetic properties of the neodymium-based rare earth permanent magnet produced in Comparative Example 1 are respectively shown in Table 1. As shown in Table 1, the neodymium-based rare earth permanent magnet of Comparative Example 1 had a purity level of 2N (99 wt %). Here, the maximum energy product (BH)max was approximately 46 MGOe, and the result was inferior in comparison to Examples 1 to 3. Moreover, both the corrosion resistance and heat resistance were inferior in comparison to the Examples.

Composition: 26Nd-5Dy-68Fe-1B

Comparative Example 2

26 kg of a commercially available neodymium raw material having a purity level of 2N were prepared. Moreover, 68 kg of a commercially available iron raw material having a purity level of 3N was prepared. Moreover, 1 kg of a commercially available boron raw material having a purity level of 2N was prepared. In addition, 5 kg of a commercially available dysprosium raw material having a purity level of 2N was prepared.

The subsequent processes were performed based on the same conditions as Example 1.

The purity and magnetic properties of the neodymium-based rare earth permanent magnet produced in Comparative Example 2 are respectively shown in Table 1. As shown in Table 1, the neodymium-based rare earth permanent magnet of Comparative Example 2 had a purity level of 2N (99 wt %). Here, the maximum energy product (BH)max was approximately 40 MGOe, and the result was inferior in comparison to Examples 4 to 6. Moreover, both the corrosion resistance and heat resistance were considerably inferior in comparison to the Examples. Moreover, while the heat resistance improved in comparison to Comparative Example 1 in which dysprosium was not added, the maximum energy product (BH)max deteriorated slightly.

Composition: 21Nd-10Dy-68Fe-1B

Comparative Example 3

21 kg of a commercially available neodymium raw material having a purity level of 2N were prepared. Moreover, 68 kg of a commercially available iron raw material having a purity level of 3N was prepared. Moreover, 1 kg of a commercially available boron raw material having a purity level of 2N was prepared. In addition, 10 kg of a commercially available dysprosium raw material having a purity level of 2N was prepared.

The subsequent processes were performed based on the same conditions as Example 1.

The purity and magnetic properties of the neodymium-based rare earth permanent magnet produced in Comparative Example 3 are respectively shown in Table 1. As shown in Table 1, the neodymium-based rare earth permanent magnet of Comparative Example 3 had a purity level of 2N (99 wt %). Here, the maximum energy product (BH)max was inferior in comparison to Examples 7 to 9. Moreover, both the corrosion resistance and heat resistance were considerably inferior in comparison to the Examples. Moreover, while the heat resistance further improved as a result of increasing the additive amount of dysprosium in comparison to Comparative Example 2, the maximum energy product (BH)max deteriorated.

TABLE 1

| | Composition | Purity of Magnet | Main Impurities (wtppm) Al | W | Mo | Ca | Si | Purity of Raw Material Nd | Fe | B | Dy | (BH) max | Corrosion Resistance | Heatproof Temperature (° C.) |
|---|---|---|---|---|---|---|---|---|---|---|---|---|---|---|
| Example 1 | 31Nd—68Fe—1B | 3N | 21 | 34 | 18 | 8 | 110 | 3N | 4N | 2N | — | 54 | ○ | 160 |
| Example 2 | | 4N | 8 | 12 | 3 | 6 | 24 | 4N | 4N | 2N | — | 59 | ◎ | 210 |
| Example 3 | | 5N | 2 | 1 | <1 | 1 | 1 | 5N | 5N | 4N | — | 62 | ◎ | 250 |
| Comparative Example 1 | | 2N | 340 | 120 | 80 | 52 | 1500 | 2N | 2N | 2N | — | 46 | X | 110 |
| Example 4 | 26Nd—5Dy—68Fe—1B | 3N | 34 | 31 | 21 | 19 | 83 | 3N | 4N | 2N | 3N | 45 | ○ | 180 |
| Example 5 | | 4N | 8 | 7 | 3 | 3 | 25 | 4N | 4N | 4N | 4N | 54 | ○ | 220 |
| Example 6 | | 5N | 1 | <1 | <1 | 1 | 1 | 5N | 5N | 4N | 4N | 59 | ◎ | 280 |
| Comparative Example 2 | | 2N | 460 | 140 | 120 | 63 | 2500 | 2N | 2N | 2N | 2N | 40 | X | 160 |
| Example 7 | 21Nd—10Dy—68Fe—1B | 3N | 26 | 52 | 35 | 67 | 150 | 3N | 4N | 2N | 3N | 40 | ○ | 250 |
| Example 8 | | 4N | 12 | 9 | 6 | 11 | 31 | 4N | 4N | 4N | 4N | 47 | ○ | 280 |
| Example 9 | | 5N | 2 | <1 | <1 | 1 | 2 | 5N | 5N | 4N | 4N | 52 | ◎ | 320 |
| Comparative Example 3 | | 2N | 610 | 190 | 150 | 120 | 3200 | 2N | 2N | 2N | 2N | 36 | X | 220 |

Since the neodymium-based rare earth permanent magnet of the present invention can have remarkably-improved magnetic properties achieved by applying a high purification technique to the magnetic materials, and additionally have improved heat resistance and corrosion resistance, which are inherent drawbacks of magnetic materials, the present invention is useful for providing a high-performance neodymium-based rare earth permanent magnet without complicating the production process.

The invention claimed is:

1. A method of producing a neodymium-based rare earth permanent magnet, comprising the steps of:

refining a neodymium raw material and an elemental, uncompounded boron raw material by molten salt electrolysis to achieve a purity of 99.99 wt % or higher, refining an iron raw material by aqueous electrolysis to achieve a purity of 99.99 wt % or higher, subsequently vacuum melting a compound obtained by combining the refined neodymium, the refined iron, and the refined boron to obtain an ingot, pulverizing the ingot to produce a powder, molding the powder by pressing, sintering and subjecting the obtained molding to heat treatment to produce a sintered compact, and subjecting the sintered compact to surface treatment to produce a neodymium-based rare earth permanent magnet consisting of Nd, Fe, B, impurities, and gas components and having a purity, excluding gas components, Nd, Fe and B, of 99.99 wt % or higher such that the impurities are limited to 100 wtppm or less in total, and wherein a content of Al as one of said impurities is 34 wtppm or less.

2. The method of producing a neodymium-based rare earth permanent magnet according to claim 1, wherein the neodymium raw material is refined by molten salt electrolysis to achieve a purity of 99.999% or higher, and the iron raw material is refined by aqueous electrolysis to achieve a purity of 99.999% or higher.

3. The method of producing a neodymium-based rare earth permanent magnet according to claim 2, wherein metal plating is performed after the surface treatment.

4. The method of producing a neodymium-based rare earth permanent magnet according to claim 1, wherein metal plating is performed after the surface treatment.

5. The method of producing a neodymium-based rare earth permanent magnet according to claim 1, wherein said content of Al is 21 wtppm or less.

6. The method of producing a neodymium-based rare earth permanent magnet according to claim 5, wherein said content of Al is 2 to 21 wtppm.

7. The method of producing a neodymium-based rare earth permanent magnet according to claim 6, wherein the purity of the neodymium-based rare earth permanent magnet, excluding gas components, Nd, Fe and B, is 99.999 wt % or higher such that the impurities are limited to 10 wtppm or less in total.

8. The method of producing a neodymium-based rare earth permanent magnet according to claim 1, wherein the neodymium-based rare earth permanent magnet has a maximum energy product (BH)max, which is a product of residual magnetic flux density (B) and coercive force (H), of 47 or more.

9. The method of producing a neodymium-based rare earth permanent magnet according to claim 1, wherein the neodymium-based rare earth permanent magnet has a heatproof temperature, below which demagnetization does not occur, of 210° C. or higher.

10. A method of producing a neodymium-based rare earth permanent magnet, comprising the steps of:

refining a neodymium raw material and an elemental, uncompounded boron raw material by molten salt electrolysis to achieve a purity of 99.99 wt % or higher;

refining an iron raw material by aqueous electrolysis to achieve a purity of 99.99 wt % or higher;

refining a dysprosium raw material by vacuum distillation to achieve a purity of 99.99 wt % or higher;

subsequently vacuum melting a compound obtained by combining the refined neodymium, the refined iron, the refined boron, and refined dysprosium to obtain an ingot;

pulverizing the ingot to produce a powder;

molding the powder by pressing;

sintering and subjecting the obtained molding to heat treatment to produce a sintered compact; and subjecting the sintered compact to surface treatment to produce a neodymium-based rare earth permanent magnet consisting of Nd, Dy, Fe, B, impurities, and gas components and having a purity, excluding gas components, Nd, Dy, Fe and B, of 99.99 wt % or higher such that the impurities are limited to 100 wtppm or less in total, and wherein a content of Al as one of said impurities is 34 wtppm or less.

11. The method of producing a neodymium-based rare earth permanent magnet according to claim 10, wherein the neodymium raw material is refined by molten salt electrolysis to achieve a purity of 99.999% or higher, and the iron raw material is refined by aqueous electrolysis to achieve a purity of 99.999% or higher.

12. The method of producing a neodymium-based rare earth permanent magnet according to claim 10, further comprising the step of metal plating the sintered compact after the surface treatment.

13. The method of producing a neodymium-based rare earth permanent magnet according to claim 10, wherein the purity of the neodymium-based rare earth permanent magnet, excluding gas components, Nd, Dy, Fe and B, is 99.999 wt % or higher such that the impurities are limited to 10 wtppm or less in total.

14. The method of producing a neodymium-based rare earth permanent magnet according to claim 10, wherein the neodymium-based rare earth permanent magnet has a maximum energy product (BH)max, which is a product of residual magnetic flux density (B) and coercive force (H), of 47 or more.

15. The method of producing a neodymium-based rare earth permanent magnet according to claim 10, wherein the neodymium-based rare earth permanent magnet has a heat-proof temperature, below which demagnetization does not occur, of 210° C. or higher.

16. The method of producing a neodymium-based rare earth permanent magnet according to claim 10, wherein said content of Al is 1 to 34 wtppm.

* * * * *